US008496279B2

(12) United States Patent
Aoki

(10) Patent No.: US 8,496,279 B2
(45) Date of Patent: Jul. 30, 2013

(54) LIFTING HOOK DEVICE

(75) Inventor: Mitsuo Aoki, Shizuoka (JP)

(73) Assignee: Aoki Machinery Co., Ltd., Shizuoka (JP)

( * ) Notice: Subject to any disclaimer, the term of this patent is extended or adjusted under 35 U.S.C. 154(b) by 0 days.

(21) Appl. No.: 13/377,685

(22) PCT Filed: Jun. 22, 2009

(86) PCT No.: PCT/JP2009/061311

§ 371 (c)(1),
(2), (4) Date: Dec. 12, 2011

(87) PCT Pub. No.: WO2010/150336

PCT Pub. Date: Dec. 29, 2010

(65) Prior Publication Data

US 2012/0080895 A1 Apr. 5, 2012

(51) Int. Cl.
*B66C 1/34* (2006.01)
*B66C 13/04* (2006.01)

(52) U.S. Cl.
USPC ..... 294/82.15; 318/161

(58) Field of Classification Search
USPC ..... 294/82.15, 82.16, 86.41, 907; 254/93 R, 254/277; 318/161, 140, 150, 146; 212/272, 212/308; 348/135
See application file for complete search history.

(56) References Cited

U.S. PATENT DOCUMENTS

| | | | | |
|---|---|---|---|---|
| 2,215,431 | A * | 9/1940 | Sloan et al. | 294/82.15 |
| 2,620,160 | A * | 12/1952 | Ray | 294/82.15 |
| 3,633,961 | A * | 1/1972 | Speransky et al. | 294/82.15 |
| 3,792,787 | A * | 2/1974 | Maloney | 294/82.15 |
| 4,930,828 | A * | 6/1990 | Rerat | 294/82.15 |
| 5,071,184 | A * | 12/1991 | Dessaux | 294/82.15 |
| 2009/0225161 | A1 * | 9/2009 | Otani et al. | 348/135 |
| 2009/0295178 | A1 * | 12/2009 | Corcoran | 294/82.15 |
| 2011/0011818 | A1 * | 1/2011 | Corcoran | 294/82.15 |

FOREIGN PATENT DOCUMENTS

| | | |
|---|---|---|
| JP | 50-100762 | 8/1975 |
| JP | 59-88083 | 6/1984 |
| JP | 62-46894 | 2/1987 |
| JP | 3-51295 | 3/1991 |
| JP | 5-24783 | 2/1993 |
| JP | 6-156970 | 6/1994 |
| JP | 06-255983 | 9/1994 |
| JP | 7-228468 | 8/1995 |

OTHER PUBLICATIONS

International Search Report issued Sep. 29, 2009 in International (PCT) Application No. PCT/JP2009/061311.

* cited by examiner

*Primary Examiner* — Paul T Chin
(74) *Attorney, Agent, or Firm* — Wenderoth, Lind & Ponack, L.L.P.

(57) ABSTRACT

A lifting hook device includes a fixed hook for lifting disposed at a head section of a hollow body having an inside maintained airtight, and a rotatable hook for suspending a load, the rotatable hook has a shaft section rotatably supported in the body and vertically suspended from a bottom section, a motor for rotating the shaft section of the rotatable book about the axis of the shaft section through a rotating mechanism, an azimuth sensor mounted to the rotatable hook and detecting the rotational azimuth of the rotatable hook, and a control section for controlling rotation of the motor to restrict the orientation of the rotatable hook to a predetermined direction.

5 Claims, 3 Drawing Sheets

LIFTING HOOK DEVICE

BACKGROUND OF THE INVENTION

I. Technical Field

The present invention relates to a lifting hook device for lifting up a load by suspension on a wire-rope vertically suspended from a winch, such as a crane etc., and furthermore relates to a lifting hook device that lifts so as to constantly maintain a certain direction by avoiding the rotation of the load when especially lifting up the load from an altitude.

II. Description of the Related Art

In general, a lifting hook device is used for mounting and cargo handling in a construction field and a harbor etc. In such a case, the device lifts up the load by hanging a wire-rope on a load and hanging a suspending hook vertically from a winch, such as a crane etc., on the wire-rope. However, when lifting the load, the load rotates on the suspending hook due to the effect of oscillation and wind etc., and it is in danger of hitting surrounding objects and workers. So, previously, various methods and devices have been suggested in order to stop the rotation of the load.

For example, machinery for stopping the rotation of the crane hook in such a way to mechanically-regulate the rotation of a suspending hook is described in Japanese Patent Application Laid-Open No. H07-228468 A, so that the suspending hook is vertically suspended from the housing, i.e., the body freely rotates in case of no-load, and thereby a protrusion mounted in the body is fitted on a hollow by applying the load.

Moreover, a lifting device in such a way to return the lifting device to the prescribed direction, by driving the machine for promoting a circling by a processing signal to estimate and a process that the lifting device circles in any direction by a magnetic azimuth sensor mounted on the lifting device suspended by crane, is described in Japanese Patent Application Laid-Open No. H05-24783 A.

SUMMARY OF THE INVENTION

However, the range of the applications is incapacious, because any of the above lifting hook devices are used for the machine for flatly carrying the load lifted by the crane, i.e., motivity, therefore, the lifting hook devices are restricted in work such that the height of the lifting is comparatively lower.

In particular, in the hook device described in Japanese Patent Application Laid-Open No. H07-228468, even if the rotation of the suspending hook suspending the load is regulated, when (two) lengths of wire-ropes for lifting, vertically suspended from a crane and suspending the main body, are long, safely lifting the load is difficult since the wire-ropes still swing and rotate under vibrancy and wind etc.

Moreover, the lifting device, i.e., the hook device described in Japanese Patent Application Laid-Open No. H05-24783 is provided with a rotational and universal hook suspending a hook vertically suspending from a crane in a head of a body and has a fixed hook for lifting up the load, which is integrally suspended with the body in a bottom of the body, to the head of the body. Whereas the construction of the device described in Japanese Patent Application Laid-Open No. H05-24783 is different from a lifting hook device of the present invention having a rotational hook for suspending a load to a bottom of a body. Furthermore, the hook device described in Japanese Patent Application Laid-Open No. H05-24783, whose frame, i.e., body is cuboidally formed, has no provision for problems of air resistance and a rotation of the body when lifting up the hook device to a particular altitude and rain water etc.

In case of lifting up the load to a particularly altitude, for example, in the case accidents, such as a water accident in sea and river etc., a fire accident in a high-rise building, or distress in mountains by climbing and skiing etc., a helicopter goes into these actions, twisting the long wire-rope vertically suspended from midair (of the helicopter) around the distress person(s), and the distress person(s) is/are saved by lifting up with a rescue worker by a winch mounted on the helicopter, however, in this way, when lifting up the distress person(s) by vertically suspending the long wire-rope from altitude, the lift-up working in a time-sensitive situation is more difficult because the loads, i.e., the rescue worker and the distress person(s) swing and rotate in a horizontal direction thereby strongly receiving air and whether, in particular, in the process of lifting up.

It is an object of the present invention to improve the prior art, and the purpose of the present invention is to provide a lifting hook device which can, irrespective of the height of lifting, stably and quickly lift up a load with the load constantly oriented to a certain direction.

In order to accomplish the present invention, a lifting hook device, having a fixed hook for lifting on a head section of a body and a rotatable hook for suspending a load on a bottom section of said body, which is fixed and mounted the fixed hook in the head section of the body having an inside maintained airtight, whereas a shaft section is rotatably supported the rotatable hook inside the body, and a hook section is mounted in such a way to vertically suspend from the bottom section of the body, wherein the body comprises a rotation mechanism for rotating a shaft section of the rotatable hook around a shaft line, a motor for rotating the shaft section in both of normal and reverse directions by driving the rotation mechanism, a battery cell which is a electrical power of the motor, an azimuth sensor for detecting a rotational direction of the rotatable hook mounted in the rotatable hook, and a control section for controlling a direction of the rotatable hook by controlling a rotation of the motor based on a directional signal detected by the azimuth sensor.

In order to accomplish the present invention, the azimuth sensor is a magnetic azimuth sensor (a GPS sensor), and a GPS antenna for detecting an electrical wave from GPS satellites is provided in the body.

In order to accomplish the present invention, the motor is remote-controlled by a switch at hand.

In order to accomplish the present invention, the azimuth sensor is provided in a top end of the shaft section of the rotatable hook.

In order to accomplish the present invention, the body has the head section conically or a conical-trapezoidally formed, and wherein a sealing element is provided in a open section which the rotatable hook of the bottom section vertically suspends.

In order to accomplish the present invention, a battery cell for driving the motor is a charging type, and the battery cell is detachably provided in the body.

In order to accomplish the present invention, the rotation mechanism comprises of a worm connected to a driving shaft of the motor and a worm wheel, placed in the shaft section of the rotatable hook, engaging to the worm.

That is, according to the lifting hook device of the present invention, the lifting hook device can, irrespective of the height of lifting, stably and quickly lift up the load suspended on the rotatable hook for suspending constantly oriented to a certain direction by employing the construction of the present invention.

In particular, according to the lifting hook device consisted in such a way as to have a GPS sensor and receive the direction on contact with a GPS antenna, it is operable to detect the certain orientation, moreover, to turn the azimuth sensor on or off by a remote-control operation, and it is easily operable by hand work in case of suspending the load on the suspending hook. Moreover, it is operable to reduce the air resistance in the lifting because the head of the body of the device is formed in conically shaped or circular truncated cone, furthermore, the device of the present invention has a advantage that it is operable to work of lifting in rainfall time or from water because the body has a waterproof structure etc.

DETAILED DESCRIPTION OF THE INVENTION

Hereinafter, the invention will now be explained in more detail with reference to figures illustrated in a drawing. As well, it goes without saying that, the present invention is not always limited to the follow embodiment, but is possible to variously change the construction without departing from the claims of the present invention.

Figure 1:
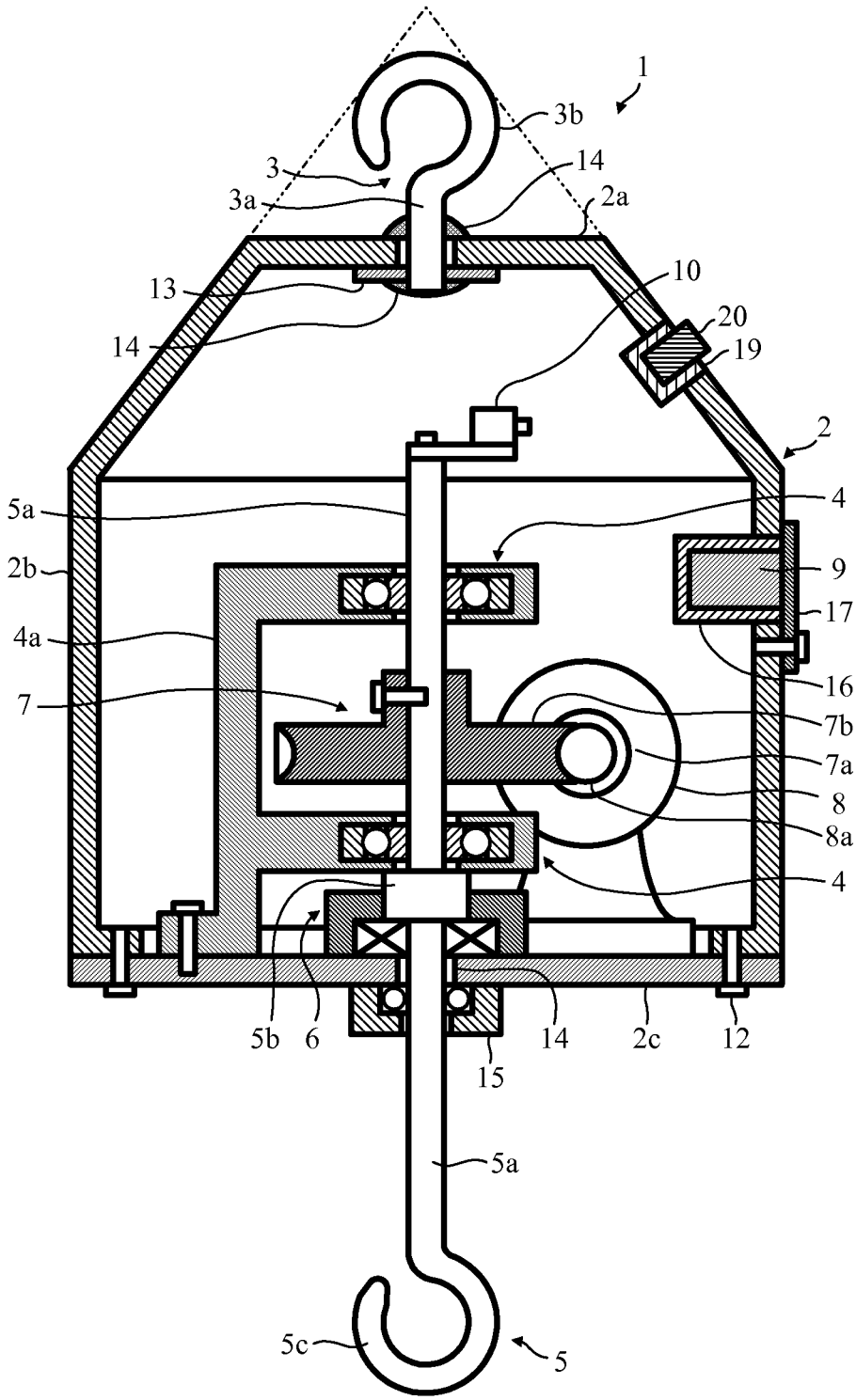
FIG. 1 is a front sectional view showing the lifting hook device in one embodiment of the present invention.
Figure 2:
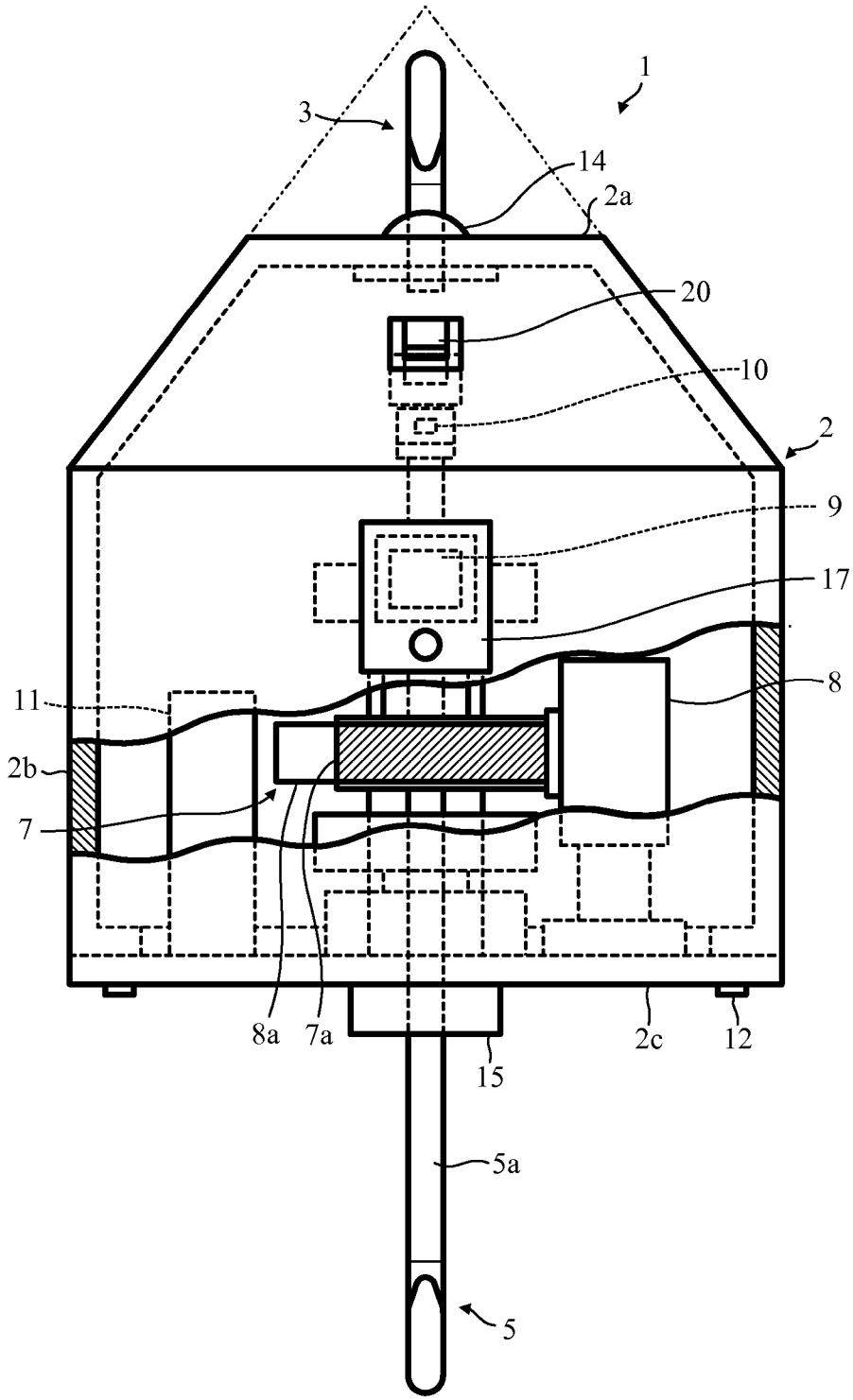
FIG. 2 is a right lateral (part of sectional) view of FIG. 1.
Figure 3:
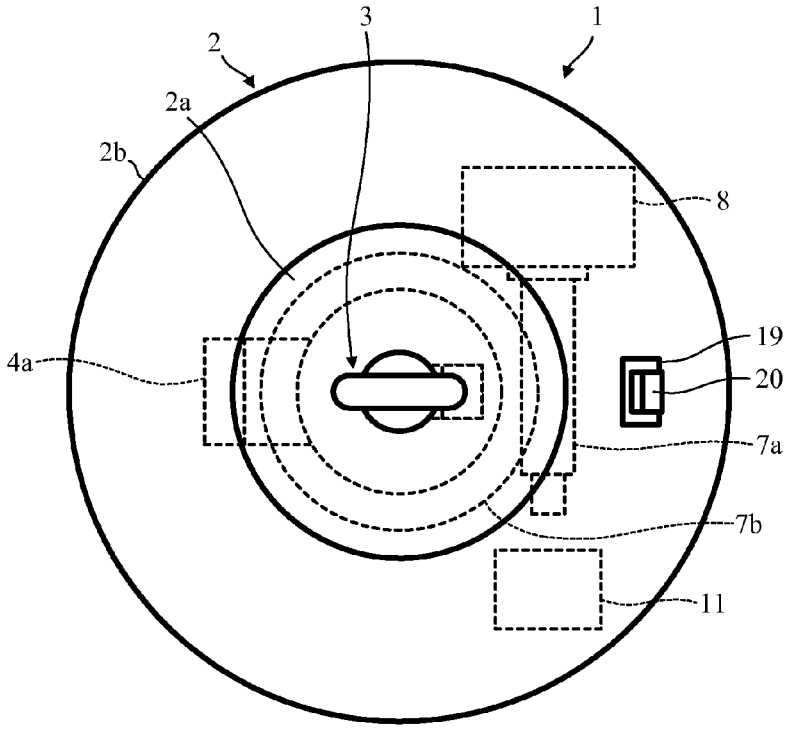
FIG. 3 is a plane view of FIG. 1.

FIG. 1 is a front sectional view showing the lifting hook device in one embodiment of the present invention, FIG. 2 is a right lateral (a part of sectional) view of FIG. 1, and FIG. 3 is a plane view of FIG. 1.

A lifting hook device 1 mainly comprises a hollow body 2 having an inside maintained airtight, a fixed hook 3 for lifting up having an shaft section 3*a* fixed to a head section 2*a* of the body 2 and a hook section 3*b* provided by projecting upward, a rotatable hook 5 for suspension having a shaft section 5*a* that is rotatably connected to a shaft ball bearing 4 attached to a bracket 4*a* in a body section 2*b* of the body 2, a stepped section 5*b* that is rotatably connected to a shaft thrust bearing 6 inside a bottom section 2*c* of the body 2, and a hook section 5*c* provided by vertically suspending from the bottom section 2*c*, a rotating mechanism 7 rotating the rotatable hook 5 around shaft line, a forward-reverse rotatable motor 8 driving the rotating mechanism 7, a battery cell 9 for supplying electric power provided in the body section 2*b* of the body 2, a magnetic azimuth sensor (GPS sensor) 10 for detecting a rotational direction of the rotatable hook 5 attached to a top section of the shaft section 5*a* of the rotatable hook 5, and a control section 11 for controlling the rotation of the motor 8 based on a sensing signal of the magnetic azimuth sensor 10 and controlling a direction of the rotatable hook 5 to a predetermined direction.

The body 2 comprises the head section 2*a*, conical-trapezoidally formed, the body section 2*b*, cylindrically junctur-ally formed in the head section 2*a*, and the bottom section 2*c* fixed a circular bottom plate by a screw/screws in an open lower surface of the body section 2*b*. In this way, when conical-trapezoidally forming the head section 2*a*, it is operable to firm the load by controlling a horizontal swing of the lifting hook device 1, thereby enabling the lifting hook device to be operable to reduce the air resistance, which the body 2 is served, when the lifting hook device 1 is lifted up (that is, transferring upward). Moreover, by cylindrically forming the body section 2*b*, the device is operable to quickly lift up the load thereby being operable to firm the body for the rotation.

As shown in FIG. 1, a reinforcing plate 13 is provided inside of the head section 2*a*, the shaft section 3*a* of the fixed hook 3 is inserted into the reinforcing plate 13, and the fixed hook 3 is fixed in and out of the head section 2*a* by a weld 14. On the hook section 3*b* of the fixed hook 3, a wire-rope for lifting up (not shown) vertically suspended from upward is suspended.

The rotatable hook 5 is provided in such a way that the bottom shaft section 5*a* is inserted into an open section 14 formed in a center section of the bottom section 2*c* of the body 2 and the hook section 5*c* is vertically suspended. As well, an O-ring 15 is provided in the open section 14 from the outside of the bottom section 2*c*, preventing a fluid from entering the inside of the body 2, and the inside of the body 2 can be mainteind airtight.

The rotating mechanism 7 comprises a worm 7*a* integrally mounted in a driving shaft 8*a* of the motor 8 and a worm wheel 7*b* engaging the worm 7*a*. The worm wheel 7*b* is fitted and fixed in the shaft section 5*a* of the rotatable hook 5, and the shaft section 5*a* is rotating around a shaft line by the driving of the motor 8. It is operable to produce a compact and an inexpensive device, because the rotating mechanism 7 is, that the construction of the mechanism 7 is simple, and does not also need a large installation space.

As presented above, the motor 8 is rotatable in both forward and backward directions, and an electric power is provided from the battery cell 9. The battery cell 9, which is a charging type, is easily put in a mounting section 16 provided a recess in the body section 2*b* of the body 2 and is closed by a cap 17. As well, the motor 8 and the battery cell 9 are commercially-supplied and heretofore known articles, and these types, performances, and capacities etc. are selected from the adequate article based on the weight and the lifting speed of the load vertically suspended to the rotatable hook 5.

A mounting section 19 is provided a recess in a position near the magnetic azimuth sensor 10 in the head section 2*a* of the body 2, and a general GPS antenna 20 for receiving an electrical wave from GPS satellite is mounted in the mounting section 19. In this way, by mounting the GPS antenna 20 in the body 2, it is operable to receive a strong electrical wave, and it is operable to detect a certain direction.

In the embodiment, the general magnetic azimuth sensor 10, which has a comparatively easily installation, is preferably used as an azimuth sensor for detecting a rotational direction of the rotatable (for suspending) hook 5.

Figure 4:
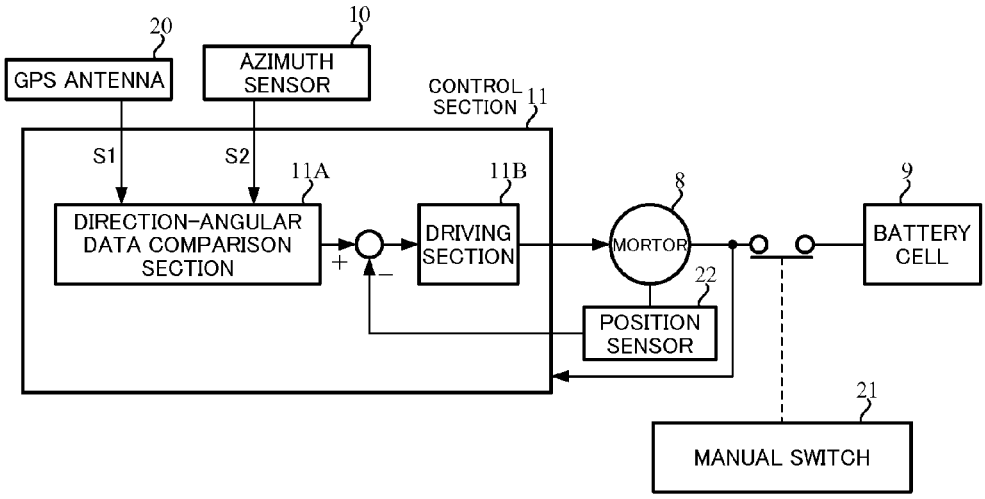
FIG. 4 is a block diagram showing a control system in the embodiment.

As shown in a block diagram of FIG. 4, the control section 11 comprises a comparison section of direction angular data 11A and a driving section 11B.

In the comparison section of direction angular data 11A, a directional information signal S1 from the GPS antenna 20 and a directional information signal S2 from the magnetic azimuth sensor 10 are input while this reference, i.e., an amount of a declination to a predetermined direction of the rotatable hook 5 is calculated, and the information is input in the driving section 11B. Rotation-positional information of the motor 8 is input in the driving section 11B through a position sensor 22, while the extent to rotate the rotatable hook 5 in any direction, right or left, to the predetermined direction based on this information is estimated. This handling signal is input in the motor 8, the rotation mechanism 7 is driven whereby the motor 8 rotates in normal or in reverse corresponding to this figure, and the rotatable hook 5 is controlled in such a way to be located in the predetermined direction.

In the embodiment, as shown by the diagram, a switch at hand 21 is mounted between the motor 8 and the battery cell 9, and the electric power of the motor 8 is turned off when freely rotating the rotatable hook 5, for example, when suspending or unloading the load to the rotatable hook 5 etc.

The lifting hook device 1 is constructed as above, therefore, has a distinguished effect as described above.

Thus, we have explained the content of the present invention based on one embodiment, but the present invention is not restricted to such embodiment as described the above.

For example, it is possible to cone the form of the head section 2*a* of the body 2 as shown by virtual lines in FIGS. 1 and 2. In this way, by coning the form of the head section 2*a*, in common with the conical-trapezoidally form of the embodiment, it is operable to reduce the air resistance, which the body 2 is served, while it is operable to firm the load by controlling the swing of the horizontal direction of the lifting hook device 1.

In this embodiment, the GPS antenna 20 is in the body 2, but it is not always necessary depending on the environmental condition, such as the condition of the receiving of the electrical wave.

Moreover, this embodiment uses the magnetic azimuth sensor as the azimuth sensor; in addition, it is possible to use a gyro-sensor or a gyro-ultrasonic sensor.

Furthermore, the lifting hook device of the present invention is not restricted to the work, such as the lifting of heavy loads by using the crane and the conveyance etc., but it is operable to optimally use in particular for the lifting work from altitude, such as the rescue work from the midair by helicopter etc.

The invention claimed is:

1. A lifting hook device, comprising a body having a head section and a bottom section;

a fixed hook configured to lift, and being on said head section of said body; and a rotatable hook configured to suspend a load on said bottom section of said body, wherein said fixed hook is fixed and mounted in said head section of said body, said body having an inside that is maintained so as to be airtight, said rotatable hook is supported by a shaft section, which is rotatably inside said body, and is mounted so as to vertically suspend from said bottom section of said body, said body comprises a rotation mechanism configured to rotate said shaft section of said rotatable hook around a shaft line, a motor configured to rotate said shaft section in both normal and reverse directions by driving said rotation mechanism, a battery cell which is electrical power for said motor, an magnetic azimuth sensor which is mounted in said rotatable hook and is configured to detect a rotational direction of said rotatable hook, a GPS antenna configured to detect an electrical wave from GPS satellites, and a control section configured to control a rotation of said motor based on a directional signal between azimuth signals detected by said magnetic azimuth sensor and said GPS antenna, and being configured to control a position of said rotatable hook to a predetermined direction, said head section is conical or conical-trapezoidal, and a sealing element is disposed in a open section which said rotatable hook of said bottom section vertically suspends.

2. The lifting hook device according to claim 1, wherein said motor is remote-controlled by a switch at hand.

3. The lifting hook device according to claim 1, wherein said azimuth sensor is disposed in a top end of said shaft section of said rotatable hook.

4. The lifting hook device according to claim 1, wherein a battery cell for driving said motor is a charging battery cell, and wherein said battery cell is detachably disposed in said body.

5. The lifting hook device according to claim 1, wherein said rotation mechanism comprises a worm connected to a driving shaft of said motor and a worm wheel, placed in the shaft section of said rotatable hook, engaging said worm.

* * * * *